US009487011B2

(12) United States Patent
Gold et al.

(10) Patent No.: US 9,487,011 B2
(45) Date of Patent: Nov. 8, 2016

(54) LATCH IMPROVEMENT FOR A PRINTER SUPPLY

(71) Applicant: INKCYCLE, INC., Lenexa, KS (US)

(72) Inventors: Kirk Gold, Lake Lotawana, MO (US); Duane Kent, Holt, MO (US); Carl Thomas Ashley, Richmond, KY (US)

(73) Assignee: Inkcycle, Inc., Lenexa, KS (US)

( * ) Notice: Subject to any disclaimer, the term of this patent is extended or adjusted under 35 U.S.C. 154(b) by 0 days.

(21) Appl. No.: 14/302,290

(22) Filed: Jun. 11, 2014

(65) Prior Publication Data

US 2015/0360473 A1 Dec. 17, 2015

(51) Int. Cl.
*B41J 2/175* (2006.01)

(52) U.S. Cl.
CPC ..... *B41J 2/17503* (2013.01); *B41J 2/1752* (2013.01); *B41J 2/17553* (2013.01)

(58) Field of Classification Search
CPC . B41J 2/17503; B41J 2/17553; B41J 2/1752
See application file for complete search history.

(56) References Cited

U.S. PATENT DOCUMENTS

| | | | | |
|---|---|---|---|---|
| 5,619,237 | A | 4/1997 | Inoue et al. | |
| 6,375,315 | B1 | 4/2002 | Steinmetz et al. | |
| 8,439,491 | B2 | 5/2013 | Hayashi et al. | |
| 2002/0180849 | A1* | 12/2002 | Sakai et al. | 347/86 |
| 2003/0071881 | A1* | 4/2003 | Toba et al. | 347/86 |
| 2013/0265373 | A1* | 10/2013 | Ota et al. | 347/86 |
| 2013/0321536 | A1* | 12/2013 | Kawate | 347/86 |

* cited by examiner

*Primary Examiner* — Bradley Thies

(57) ABSTRACT

An ink cartridge has a cartridge body and an integrally molded lever. An angle, formed between the integrally molded lever and the cartridge body, is maintained at a minimum dimension by an angle size maintaining mechanism. The angle size maintaining mechanism enables remanufacturing of a used ink cartridge to reduce printer operating cost and reduce environmental waste.

3 Claims, 7 Drawing Sheets

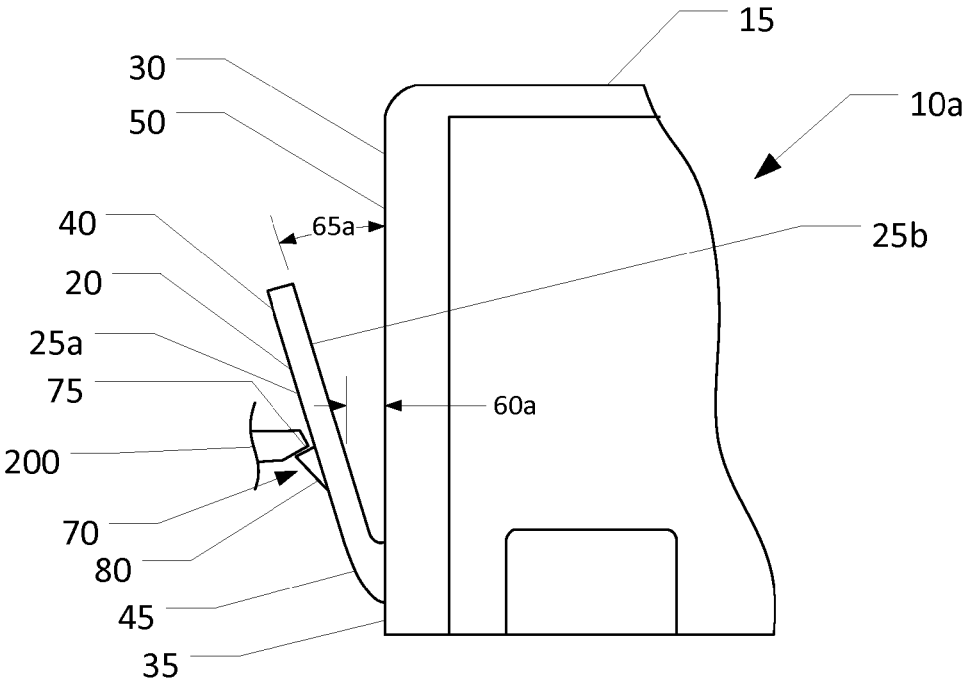
Figure 2a, View A-A
Prior Art
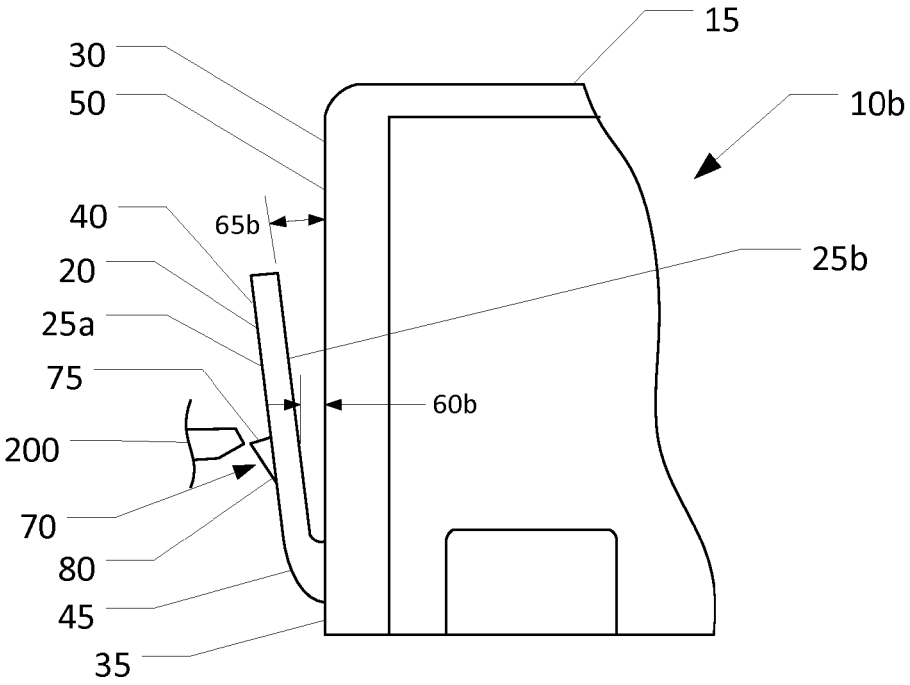
Figure 2b, View A-A
Prior Art

VIEW B-B

VIEW B-B

VIEW B-B

VIEW B-B

VIEW B-B

VIEW B-B

VIEW B-B

LATCH IMPROVEMENT FOR A PRINTER SUPPLY

BACKGROUND

1. Field of the Disclosure

The disclosed system generally relates to a lever for removably mounting one or more printer supply cartridges in a printer. In particular, this system relates to a latching mechanism for removably securing one or more ink cartridges in an inkjet printer.

2. Description of the Related Art

An inkjet printer typically includes one or more printheads and their corresponding ink cartridges. Each printhead includes an ink inlet that is connected to an ink cartridge and an array of drop ejectors, each ejector consisting of an ink pressurization chamber, an ejecting actuator and a nozzle through which droplets of ink are ejected. The ejecting actuator can be one of various types, including a heater that vaporizes some of the ink in the pressurization chamber to propel a droplet out of the orifice, or a piezoelectric device which changes the wall geometry of the chamber to generate a pressure wave that ejects a droplet. The droplets are typically directed toward paper or other recording medium to produce an image according to image data that is converted into electronic firing pulses for the drop ejectors as the recording medium is moved relative to the printhead.

One common type of inkjet printer uses a replaceable ink cartridge which contains a cartridge body, a felt, and a supply of ink contained within the ink cartridge. The print cartridge is intended for single-use and, when the initial supply of ink is depleted, the ink cartridge is disposed of and a new ink cartridge is installed. However, frequent replacement of the print cartridge results in both a relatively high operating cost and increased environmental waste.

Remanufacturers have overcome many challenges to enable re-use of ink cartridges, thereby reducing operating cost and environmental waste. An exemplary challenge is an ink cartridge having a lever and a latch having a spring element integrally molded into an ink cartridge. The latch, in combination with other features of the ink cartridge, provides positive engagement of the ink cartridge into an ink cartridge receiver.

The lever, which is integrally molded, was designed for single-use thereby suffering from permanent deformation by the end of a single-use lifetime, resulting in a compromised engagement of the latch into the ink cartridge receiver. What is needed is an improvement to an ink cartridge having an integrally molded latch to enable use beyond a single-use life, including a latch which has suffered from permanent deformation.

SUMMARY

The present system is directed to a replaceable ink cartridge having a cartridge body, an integrally molded lever a gap and angle having dimensions which separate the integrally molded lever from a front surface of a cartridge body. In preferred embodiments the cartridge body is modified to increase the gap and angle to maintain minimum dimensions capable of facilitating positive engagement into an ink cartridge receiver. In another aspect of preferred embodiments the cartridge body is modified by providing a flat spring capable of increasing the gap dimension. In yet another aspect of preferred embodiments the cartridge body is modified by configuring a compression spring to increase the gap dimension.

Various objects, features, aspects, and advantages of the disclosure will become more apparent from the following detailed description of preferred embodiments of the disclosure, along with the accompanying drawings in which like numerals represent like components.

BRIEF DESCRIPTION OF THE DRAWINGS

FIG. 2*a* is a partial side view of an ink cartridge of FIG. 1 at increased scale, showing a prior art ink cartridge in new condition, and including an engagement feature;

FIG. 2*b* is a partial side view of the ink cartridge of FIG. 1 at increased scale, showing a prior art ink cartridge at end-of-life condition, and includes an engagement feature;

DETAILED DESCRIPTION

It is to be understood that various omissions and substitutions of equivalents are contemplated as circumstances may suggest or render expedient, but these are intended to cover the application or implementation without departing from the spirit or scope of the claims of the present disclosure.

Figure 1:
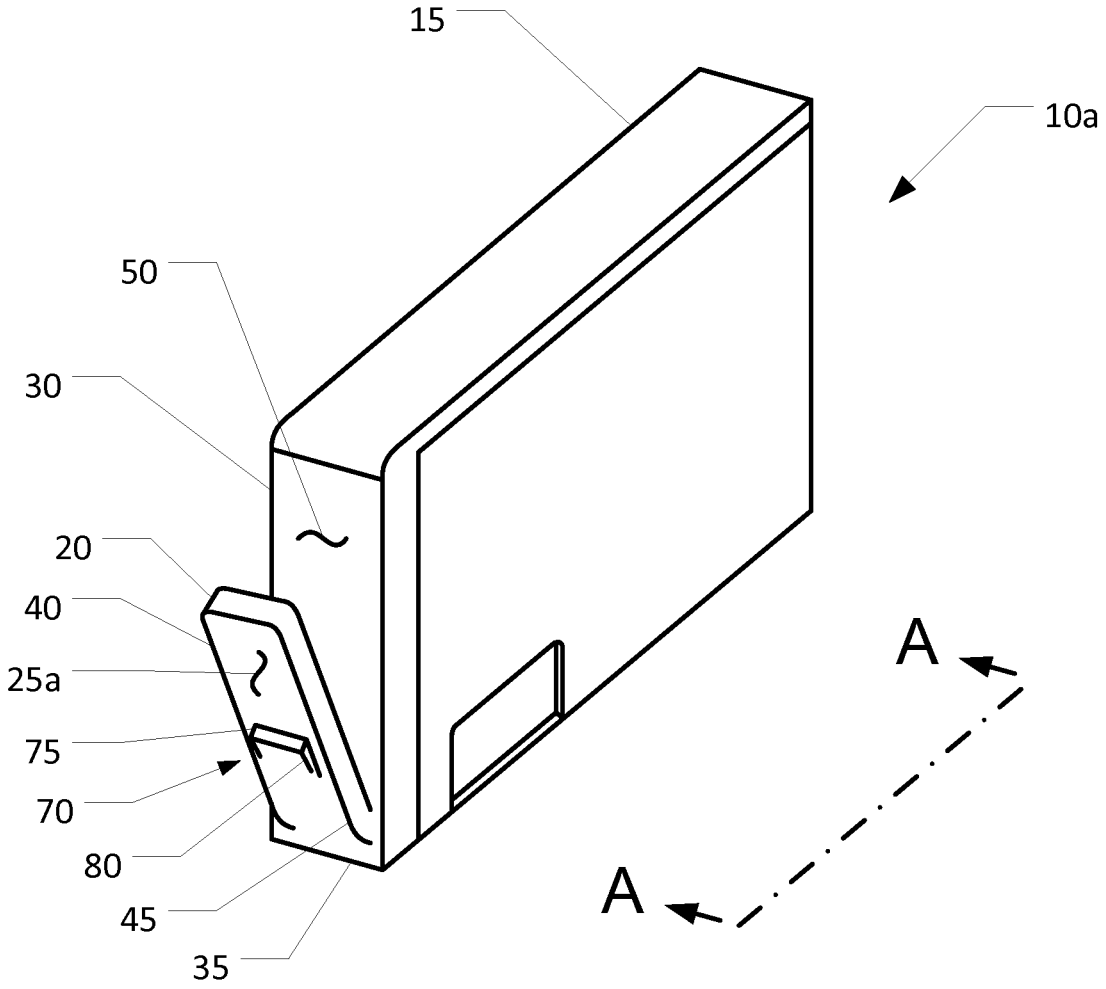
Figure 1 PRIOR ART
FIG. 1 is an isometric view of a prior art ink cartridge in new condition.

FIG. 1 shows a prior art ink cartridge in new condition (hereafter, "new ink cartridge 10*a*"). The new ink cartridge 10*a* is formed of various components, including injection molded plastic components assembled to contain ink (not shown). A cartridge body 15 includes a front surface 50. The front surface 50 includes an upper portion 30, a lower portion 35, and an integrally molded lever 20. The integrally molded lever 20 includes a fixed end 45 and a free end 40. The integrally molded lever 20 further includes a latch 70 having a lock 75 and a ramp 80.

FIG. 2*a* shows a partial side view of the new ink cartridge 10*a* of FIG. 1. The new ink cartridge 10*a* has an integrally molded lever 20, including latch 70 consisting of a lock 75 and ramp 80. The integrally molded lever 20 is shown extended away at an angle 65*a* from the front surface 50 and toward an engagement tab 200.

The engagement tab 200 is part of an ink cartridge receiver (not shown). The ink cartridge receiver is installed within an inkjet printer (not shown) and includes features for positioning the new ink cartridge 10*a* in the inkjet printer.

Integrally molded lever 20 is formed adjacent a front surface 50 of cartridge body 15. The integrally molded lever 20 has a first side 25*a* and a second side 25*b*. A gap dimension 60*a* is formed between the front surface 50 and second side 25*b*, and an angle 65*a* is formed between the front surface 50 and second side 25*b* as shown in the Figure. The integrally molded lever 20 includes a spring force which is inherent to this plastic molded feature to facilitate installation of the new ink cartridge 10*a* into the ink cartridge receiver. For new ink cartridge 10*a*, the integrally molded lever 20, having a gap dimension 60*a*, an angle 65*a*, and an effective spring rate, causes the integrally molded lever 20 to fully bias against engagement tab 200.

FIG. 2*b* shows the integrally molded lever 20 that is not biased into engagement tab 200. This is a failure that commonly occurs for ink cartridges at end-of-life (hereafter "used ink cartridge 10*b*") which are designed for single-use, resulting from the gap dimension 60*a* to decrease to a smaller dimension (as shown by 60*b*), the angle to be reduced to 65*b*, and to reduce the effective spring rate, with time due to creep. "Creep" is a common term in the plastics industry which describes the tendency of plastic to suffer permanent deformation due to mechanical stresses influenced by multiple installation cycles, increased time, temperature, mold design, gate location, and/or molding process parameters.

Figure 3:
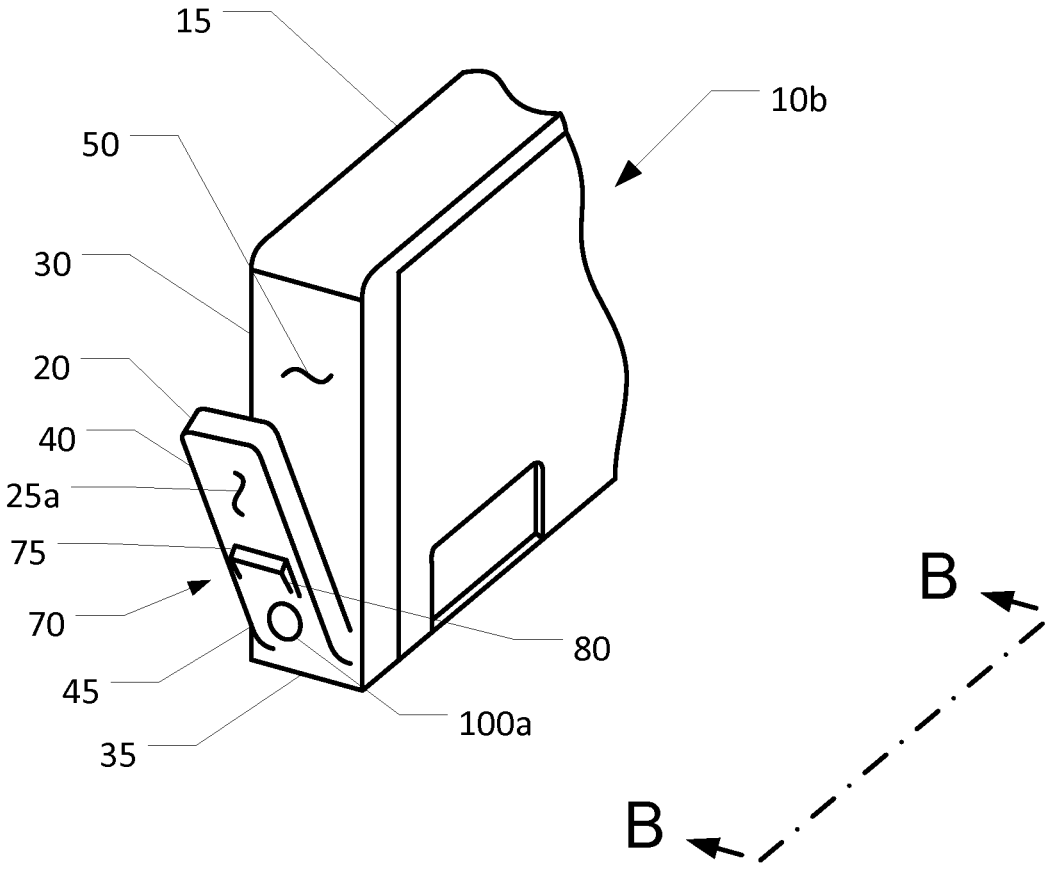
FIG. 3 is an isometric view, not to scale, of an ink cartridge at end-of-life condition having a formed feature.

FIG. 3 shows an improvement to the prior art used ink cartridge 10*a* of FIG. 1. An indention 100*a* is shown formed into the integrally molded lever 20, resulting in formed protrusion 100*b* shaped into integrally molded lever 20 as shown in FIGS. 4*a* and 4*b*, and further described below.

The process described above is an example of a post-molding process.

Figure 4A:
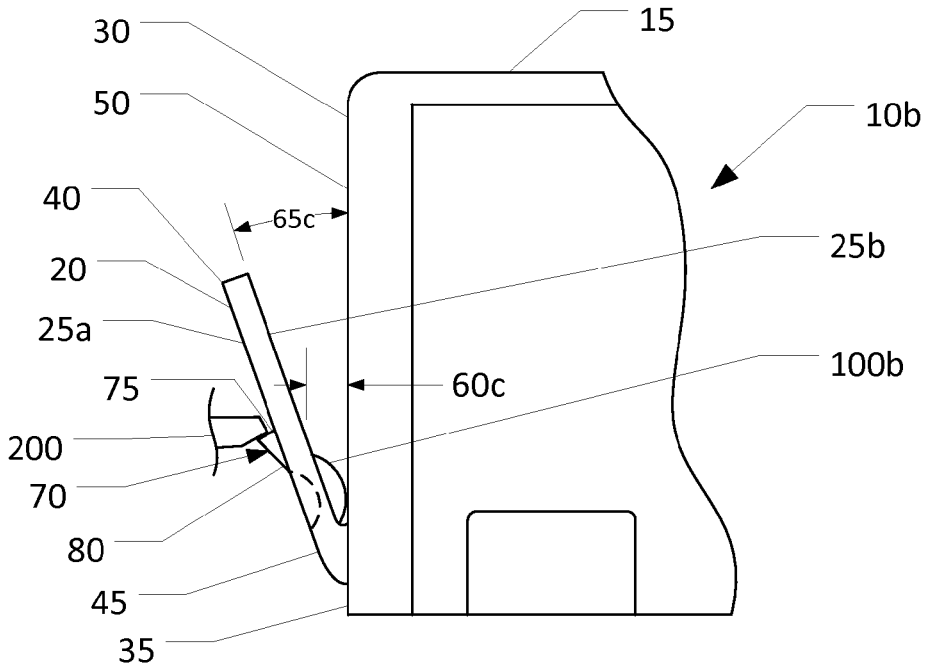
FIG. 4*a* is a partial side view taken from View B-B of FIG. 3, showing an ink cartridge having a formed feature.

FIG. 4*a* shows a side view of FIG. 3 taken from view B-B. The indention 100*a* is formed by using a press and die pair (not shown) designed specifically for this purpose. A die may be a plate shaped to support a second side 25*b* of integrally molded lever 20, wherein the die has a recess or a hole. The press is a protrusion such as a punch shaped to form indention 100*a*. During forming, the press applies a force to a first side 25*a* of integrally molded lever 20, supported by the die on the second side 25*b* of integrally molded lever 20. Plastic is formed, resulting in indention 100*a*, with plastic yielding under force into the recess or hole in the die, shaping protrusion 100*b*. Protrusion 100*b* provides a stop to positively position the gap to an established minimum dimension, thereby increasing angle 65*b* to angle 65*c* and is about equivalent to angle 65*a*. Thus, protrusion 100*b* causes a gap (and resultant angle) having a dimension 60*c* which is greater than dimension 60*b* and about equivalent to dimension 60*a*, as shown in the Figure. The protrusion 100*b* provides a support to ensure a gap of a minimum dimension (about equivalent to gap dimension 60*a*) to enable latch 70 to more fully engage with engagement tab 200.

Figure 4B:
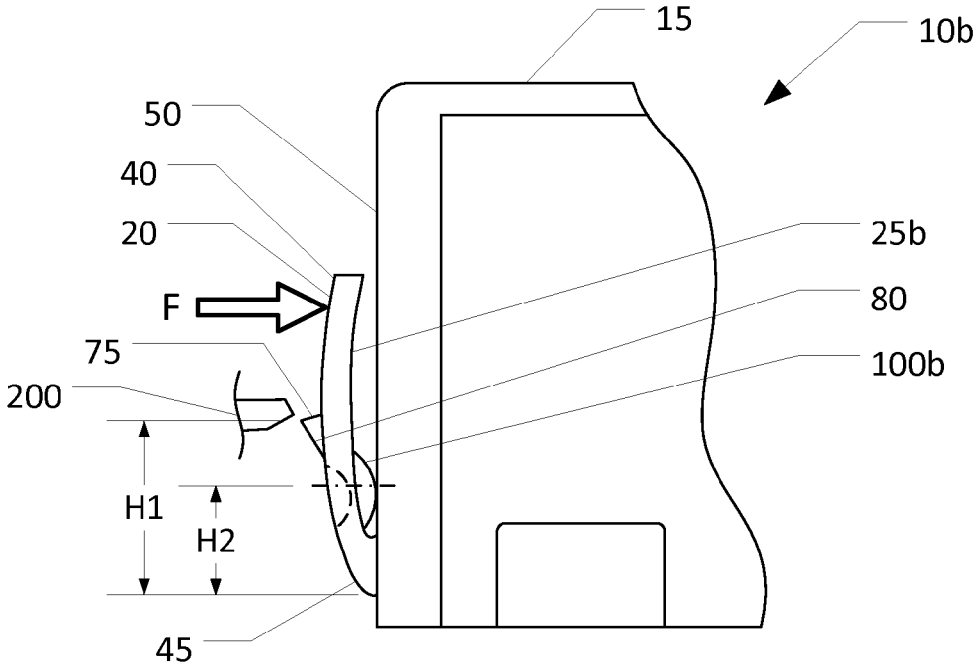
FIG. 4*b* is a partial side view taken from View B-B of FIG. 3, showing an ink cartridge having a formed feature, and having an applied force.

FIG. 4*b* shows FIG. 4*a* with a minimum of callout numbers to provide clarity of the discussion to follow. A dimension H1 defines the vertical distance from the intersection of the front surface 50 of cartridge body 15 and the fixed end 45 of integrally molded lever 20, to the intersection of the latch 70 features lock 75 and ramp 80. Dimension H2 defines the vertical distance from the intersection of the front surface 50 of cartridge body 15 and the fixed end 45 of integrally molded lever 20, to the center of protrusion 100*b*. In a preferred embodiment, protrusion 100*b* is formed having a vertical distance H2 to be less than vertical distance H1. This preserves the original installation function of used ink cartridge 10*b* by enabling latch 70 to deflect away from engagement tab 200 to form a positive engagement between engagement tab 200 and lock 75 of latch 70. This also preserves the original removal function of the used ink cartridge 10*b* by enabling a force F to be applied to the free end 40 of integrally molded lever 20, enabling the lock 75 of latch 70 to disengage from engagement tab 200, facilitating removal of the used ink cartridge 10*b* from the ink cartridge receiver (not shown).

Figure 5A:
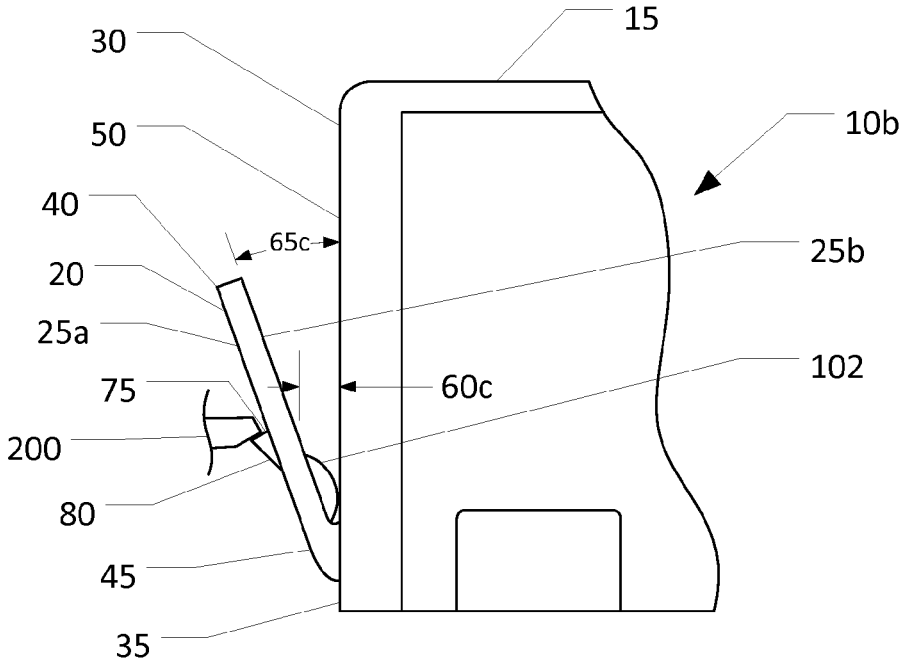
FIGS. 5*a* through 5*e* are partial side views taken from View B-B of FIG. 3 showing alternate embodiments.
Figure 5B:
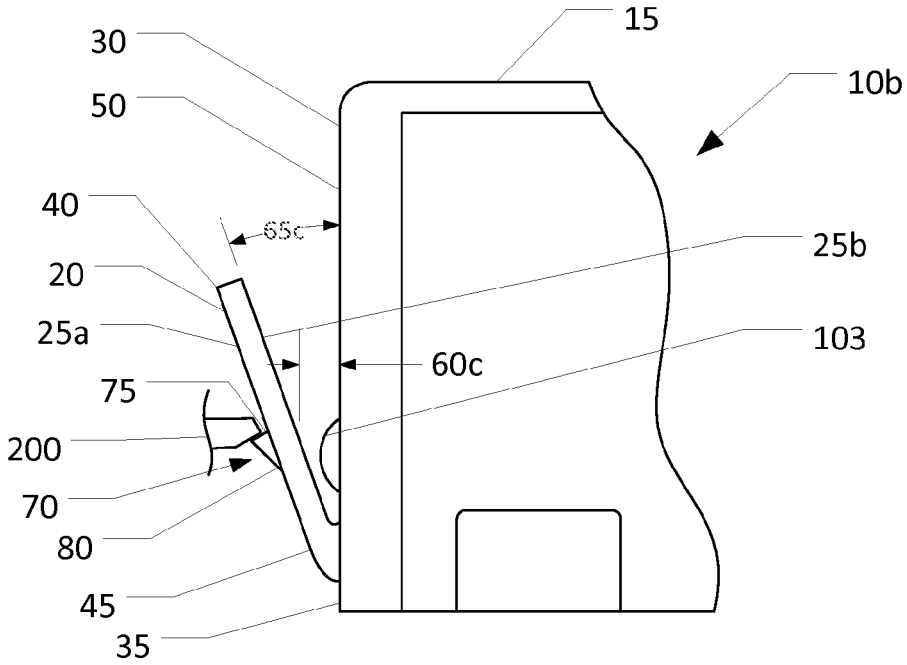

Alternate embodiments of the present disclosure are shown in FIGS. 5*a* through 5*e*, showing side views as in FIGS. 4*a* and 4*b*, taken from View A-A of FIG. 3. In FIG. 5*a*, protrusion-2 102 is formed of a raised adhesive in the same vertical position as described in relation to FIG. 4*a*, and bonded to said integrally molded lever 20. The adhesive should be of high viscosity and capable of adhering to the material of cartridge body 15 and at least partially hardening. A suitable adhesive includes, but is not limited to, 3M™ Scotch-Weld™ Hot Melt Adhesive 3738 TC. In FIG. 5*b*, there is protrusion-3 103 alternately positioned on the front surface 50 of cartridge body 15, effectively providing the equivalent function as protrusion 100*b* or protrusion-2 102. These embodiments demonstrate that a protrusion formed between the integrally molded lever 20 and the front surface 50 will increase the gap dimension by increasing the angle 65*c* and increase the effective spring rate of the integrally molded lever 20.

Figure 5C:
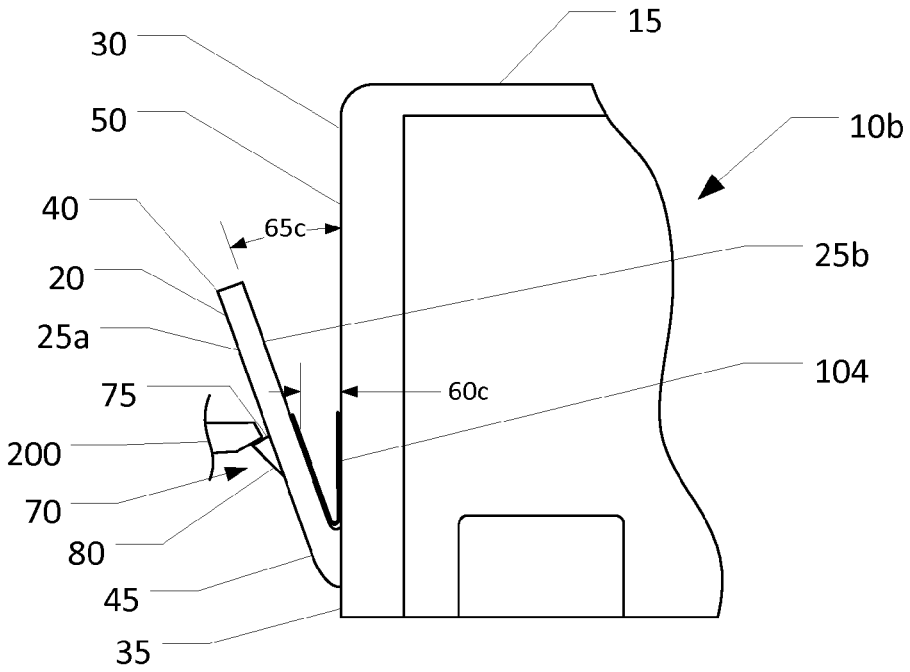

FIG. 5*c* shows a flat spring 104, formed to essentially conform (in a V-shape) to the front surface 50 of cartridge body 15 and the second side 25*b* of integrally molded lever 20. The flat spring 104 provides a force sufficient to increase the gap dimension from 60*b* to 60*c*, and the angle 65*b* to 65*c*, as with previous embodiments. The flat spring 104 is fixedly attached to at least one of the second side 25*b* and integrally molded lever 20. The flat spring 104 may be adhesively bonded preferably with a soft thermoset elastomer capable shear flexing.

An exemplary elastomer is a general purpose silicone adhesive such as MasterSil™ 711 from MasterBond®. Alternately, flat spring 104 may include mechanical features to bite into the mating plastic material (second side 25*b* and front surface 50), or other various commonly known attachment methods. Although not preferred, the flat spring 104 may be positioned in an inverted V-shape (not shown). The flat spring 104 may include bends, waves, or other similar geometry and while considered to those skilled in the art to be within the scope of a flat spring.

Figure 5D:
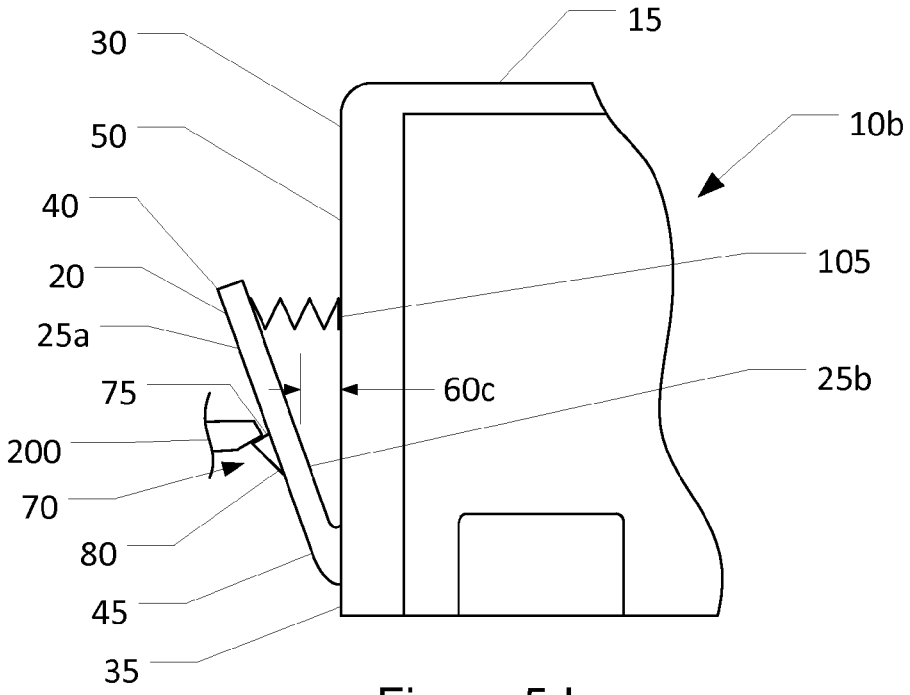

FIG. 5*d* shows a coil spring 105 positioned above latch 70 near the free end 40 of integrally molded lever 20. In contrast to the previous embodiments, a position above latch 70 will enable coil spring 105 to benefit from a longer overall length to maintain a flatter spring rate and reduce material fatigue. The coil spring 105 is fixedly attached to at least one end by one of the afore-referenced adhesives or by mechanical means. The coil spring provides a force sufficient to increase the gap dimension from 60*b* to 60*c*, and to increase the angle from 60*b* to 60*c*.

Figure 5E:
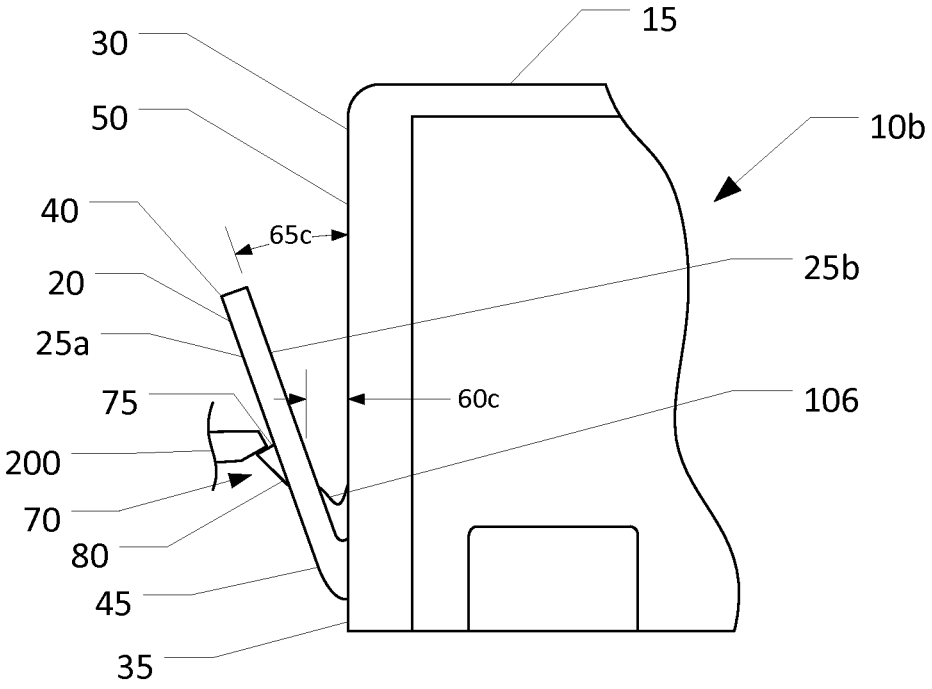

FIG. 5*e* shows an alternative protrusion to those shown in FIGS. 4*a-b* and FIGS. 5*a-b*. Adhesive 106 is formed in a crevasse between the second side 25*b* and the front surface 50 of cartridge body 15. A high viscosity soft thermoset elastomer will provide high adhesion and flexibility, such as the general purpose silicone adhesive previously referenced. In this embodiment, it is preferred to physically increase the gap to a dimension 60*c* prior to applying adhesive 106, and to maintain this increased gap until the adhesive has cured.

Yet another alternative is forming a protrusion by adhesively bonding a separate disk (not shown) or semi-sphere (not shown) to either the integrally molded lever 20 or front surface 50 of cartridge body 15. It has also been contemplated that partial protrusions of any of the above embodiments may be employed, wherein the sum of the partial protrusions would result in a gap dimension 60*c* and angle 65*c*.

FIGS. 3-5*e*, in addition to the alternatives described but not shown, disclose alternative gap size maintaining mechanisms capable of enabling an ink cartridge having an integrally molded latch to increase use beyond a single-use life, including a latch which has suffered from permanent deformation.

The above referenced examples—all of which describe post-molding examples, demonstrate the capability of increasing a gap dimension 60*b* to a gap dimension 60*c*, and angle 65*b* to 65*c*, to enable fully biased engagement of latch 70 into engagement tab 200. Thus, a used ink cartridge 10*b* is capable of performing comparable to a new ink cartridge 10*a*, enabling use beyond a single-use life.

Although the disclosure is taught with respect to used ink cartridges 10*b*, the practicalities of a remanufactured ink cartridge supply stream will inevitably result in new ink cartridges 10*a* being present with used ink cartridges 10*b*. The present disclosure is not only capable of implementation in single-use life ink cartridges, but may provide positive engagement of the ink cartridge into an ink cartridge receiver well beyond a single-use life. Therefore it is proper to generalize the present disclosure as applicable for all ink cartridges.

It is contemplated, and will be clear to those skilled in the art that modifications and/or changes may be made to the embodiments of the disclosure. Accordingly, the foregoing description and the accompanying drawings are intended to be illustrative of the example embodiments only and not limiting thereto, in which the true spirit and scope of the present disclosure is determined by reference to the appended claims.

What is claimed is:

1. An ink cartridge having a cartridge body, the cartridge body comprising a front surface having an upper portion and a lower portion, the lower portion includes an integrally molded lever having a fixed end, a free end, a first side, a second side, and a latch, wherein;

a. the integrally molded lever includes a concave indention on the first side, and a convex protrusion on the second side, formed in axial alignment by a post-molding operation, wherein the concave indention and the convex protrusion are positioned between the fixed end and the latch.

2. An ink cartridge having a cartridge body, the cartridge body comprising a front surface having an upper portion and a lower portion, the lower portion includes an integrally molded lever having a fixed end, a free end, a first side, a second side, a latch, and an acute angle between the front surface and the second side of the integrally molded lever, wherein;

a. the integrally molded lever includes an angle size maintaining mechanism having a formed protrusion to increase the angle dimension, and having a formed indention in axial alignment with the formed protrusion.

3. The ink cartridge of claim 1, wherein the integrally molded lever further comprises an inherent spring rate, and wherein;

a. the integrally molded lever includes an angle size maintaining mechanism sufficient to increase the spring rate of the integrally molded lever.

* * * * *